US006112467A

United States Patent [19]

Bark et al.

[11] Patent Number: 6,112,467

[45] **Date of Patent: *Sep. 5, 2000**

[54] DEVICE AT BULKHEAD DOOR

[76] Inventors: Tore Bark, Aprilgatan 12E, S-415 15, Göteborg; Kenneth Johansson, Agnebäcksvägen 29, S-438 32, Landvetter, both of Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/217,680

[22] Filed: Mar. 25, 1994

[30] Foreign Application Priority Data

Apr. 8, 1993 [SE] Sweden ..... 9301205

[51] Int. Cl.[7] ..... E06B 7/28

[52] U.S. Cl. ..... 49/321; 49/306

[58] Field of Search ..... 49/306, 307, 310, 49/311, 319, 320, 321

[56] References Cited

U.S. PATENT DOCUMENTS

| | | | |
|---|---|---|---|
| 3,059,287 | 10/1962 | Baruch et al. | 49/307 |
| 3,098,519 | 7/1963 | Myers et al. | 49/306 X |
| 4,277,920 | 7/1981 | Dixon | 49/321 X |
| 4,656,779 | 4/1987 | Fedeli | 49/321 X |

FOREIGN PATENT DOCUMENTS

| | | | |
|---|---|---|---|
| 2642107 | 7/1990 | France | 49/310 |

*Primary Examiner*—Jerry Redman
*Attorney, Agent, or Firm*—Dvorak & Orum

[57] ABSTRACT

A device at a bulkhead door (5) or a similar element for closing an opening edge in a ship, and which is actuatably movable to form a seal between peripheral edge of the door and a surrounding opening edge. A sealing function exhibiting at least along one horizontal edge area of the door extending sealing portion (19) connected with the door sheet (9) or above situated deck area being supported movable essentially along the closing plane of the door sheet.

5 Claims, 5 Drawing Sheets

DEVICE AT BULKHEAD DOOR

BACKGROUND OF THE INVENTION

The present invention refers to a device at a bulkhead door or a similar element for closing an opening edge in a ship or the like, and which is actuateably movable for the purpose of achieving a seal between the peripheral edge of the door and a surrounding opening edge.

Spaces at doors aboard ships or similar places where there may occur a risk of water penetration are frequently limited vertically, since vehicles and other cargoes with large height are transported. In order to achieve sealing at similar bulkhead doors at one edge, one has earlier among other things used a pivotable sealing device according to for example SE-A-8201332-7. Pivotable seals however, require considerable space vertically due to rotational movement.

The main object of the present invention is therefore at first hand to achieve a device, which by simple and well functioning means solves above said problem to achieve sealing and closing along at least the horizontal edge area of a door at limited small space in vertical direction.

Said object is achieved by means of a device according to the present invention, which mainly is characterized therein, that a sealing function exhibiting, at least along one horizontal edge area of the door extending sealing portion connected with the door sheet or above situated deck area being supported movable essentially along the closing plane of the door sheet.

BRIEF DESCRIPTION OF THE DRAWINGS

The invention is described in the following such as two preferred embodiments referred to in the enclosed drawings, in which.

DETAILED DESCRIPTION OF THE INVENTION

Figure 1:
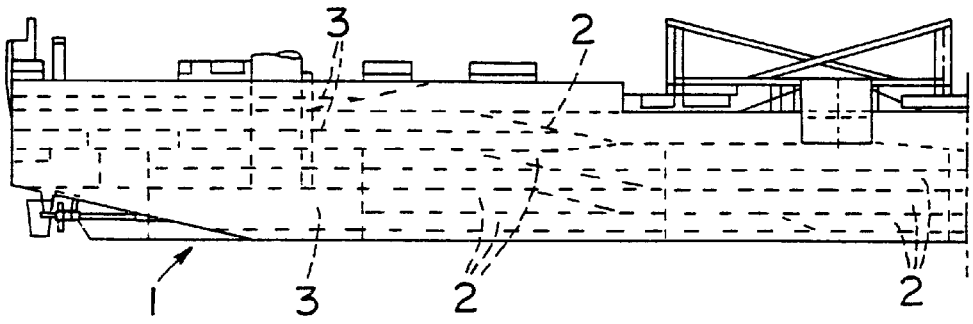
FIG. 1 shows part of a ship with existing cargo spaces.

A ship 1 shown in FIG. 1 exhibits several separate loading spaces 2, which one wishes to close isolated and waterproof from each other and from other spaces 3. Normally thereby is found a small space L at the upper edge 4 of the bulkhead doors 5, which close openings 6 between the spaces 2, 3.

According to the present invention a device 7 includes at a bulkhead door 5 of the type, or any similar covering element, intended for closing an opening 6 of the type in a ship 1 or the like in its interior, and which is actuateably movable in a direction 8 essentially along the present closing plane 10 of the door sheet 9, for the purpose of achieving a seal between the peripheral edge 11, 12, 13, 14 of the door and surrounding opening edge 15, 16, 17, 18, a sealing portion 19, 20, 21, 22 exhibiting a sealing function. There is at least one horizontal sealing portion 19, 20 provided to extend along one of horizontal edge areas 4, 4A of the door and which is connected with the door sheet 9 or a deck area 23 situated above. At least one of said horizontal sealing portions 19, 20 according to the invention is supported movable in a direction 24, which extends essentially parallel along the door sheet and its intended closing plane 10.

Figure 2:
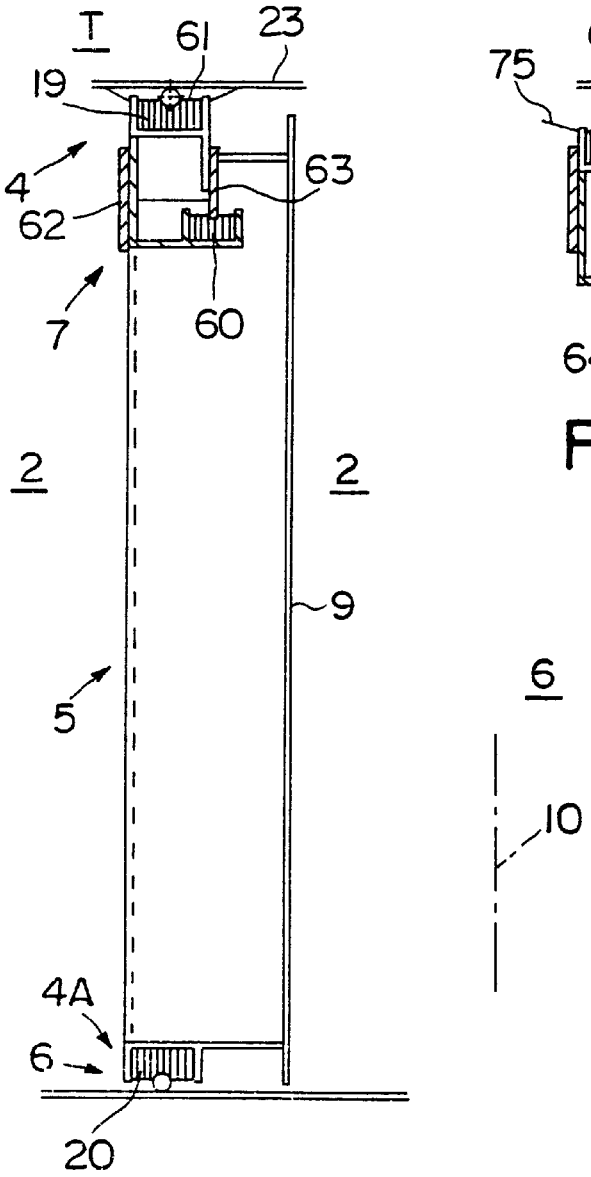
FIG. 2 shows a sectional view along the line II—II in FIG. 4 of a door including a sealing device in the sealing position shown.
Figure 3:
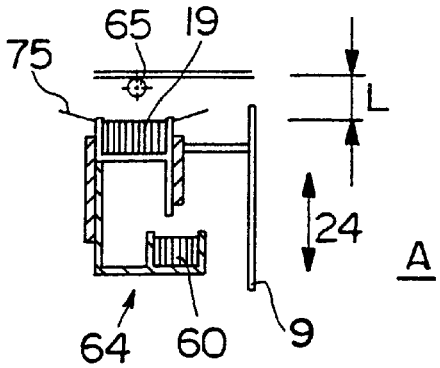
FIG. 3 shows the sealing device in exposed position.
Figure 4:
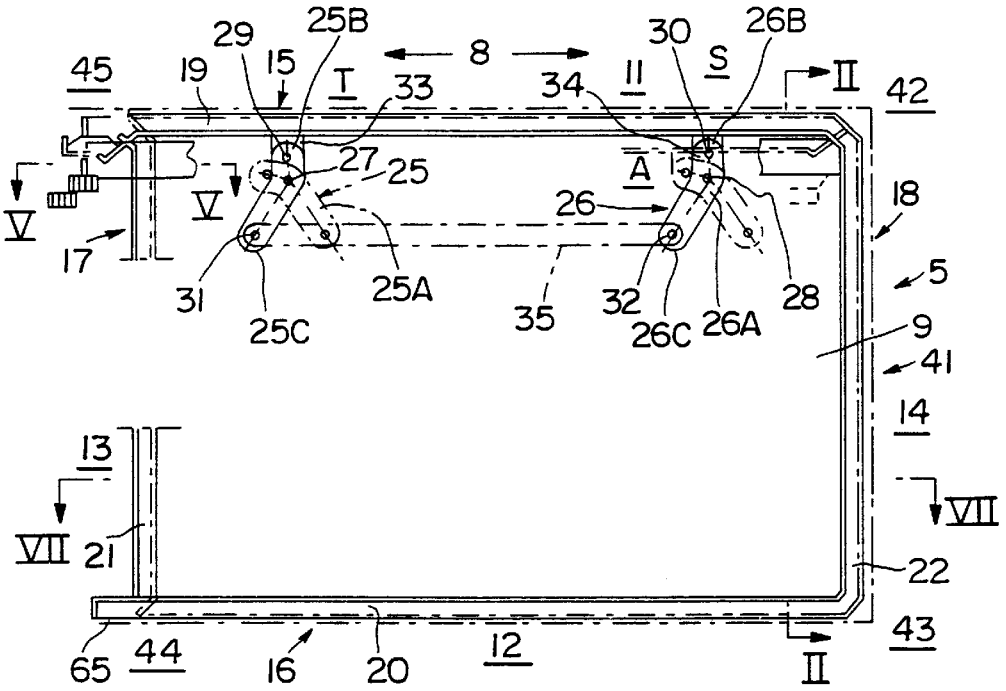
FIG. 4 shows a diagrammatic lateral view of a complete door seal arranged round about.
Figure 5:
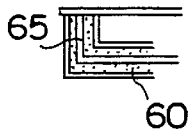
FIG. 5 shows a sectional view along the line V—V in FIG. 4.
Figure 6:
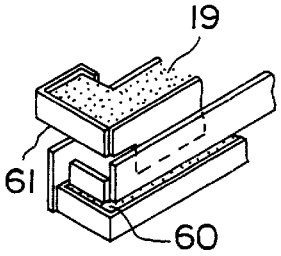
FIG. 6 shows a perspective view of a corner part of the door and the seal thereof.
Figure 7:
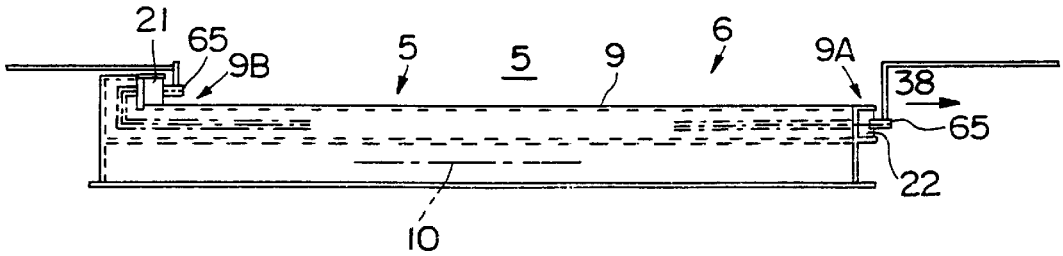
FIG. 7 shows a sectional view along the line VII—VII in FIG. 4.
Figure 8:
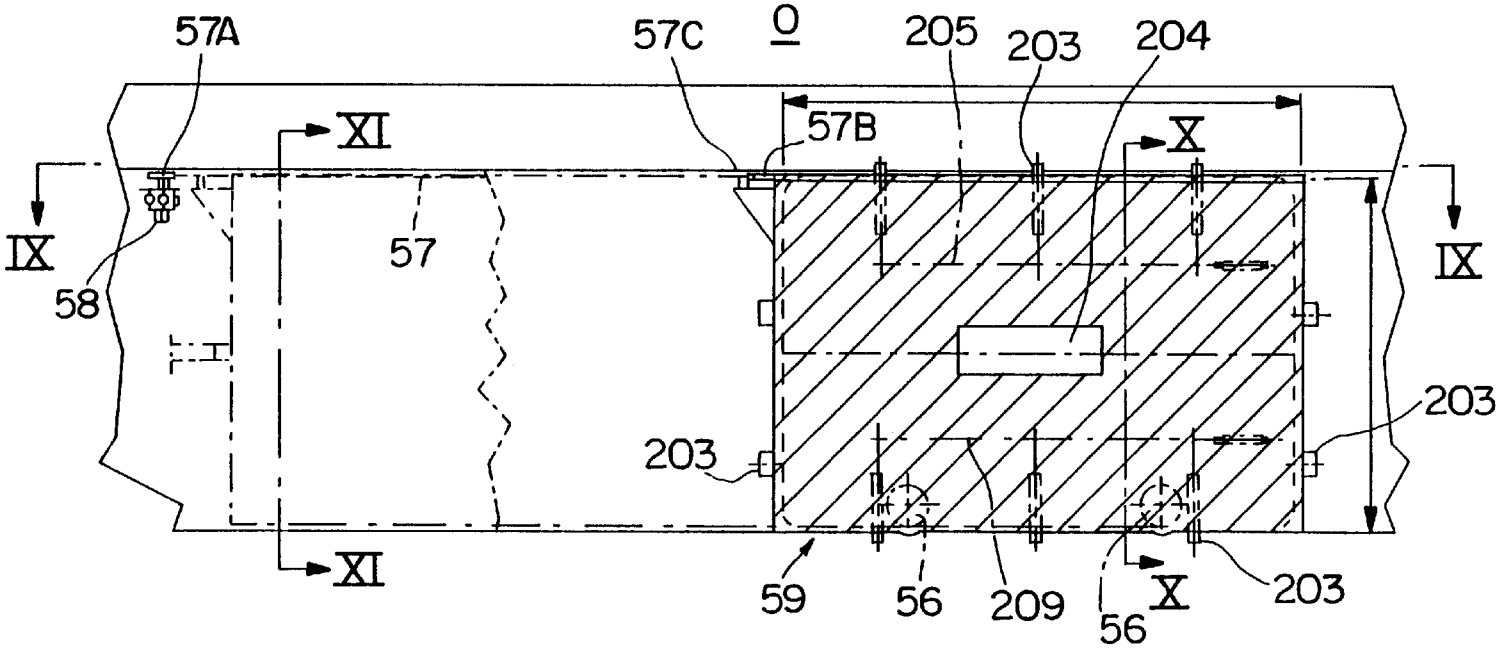
FIG. 8 shows an elevational view of a door opening with the door opened.
Figure 9:
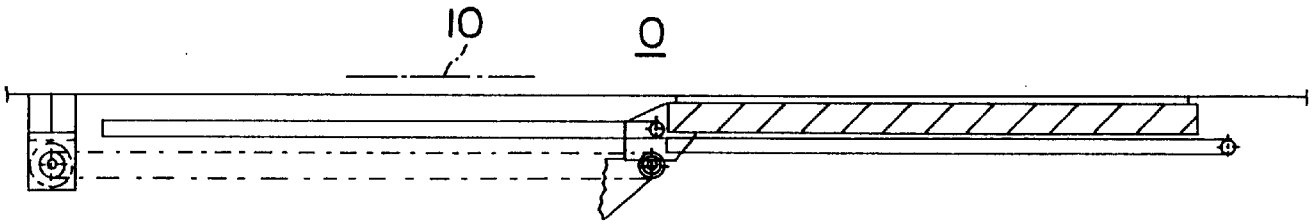
FIG. 9 shows a view seen along the line IX—IX in FIG. 8.

The movable upper sealing portion 19 is for example arranged on bearings displaceable from a pulled down bearing position A, such as for example is shown in FIG. 3 and 4, and in which position A of the seal 19 the door sheet 9 is allowed to be influenced to be relocated between opened position O, FIGS. 8–9, and closed position, FIGS. 4 and 7 respectively, and a pushed up sealing position T, FIGS. 2 and 4, at the closed position of the door sheet 9.

The above situated movable groove shaped sealing portion 19 can be pivotably arranged in longitudinal direction of the door, displaceable via pivot arms 25, 26, for example pivot arms 25, 26 in pairs with angled configuration, at the central part 25A, 26A of which they are arranged on bearings at the door sheet 9 about pivot joints 27, 28. The outer end 25B, 26B and 25C, 26C of the pivot arms 25, 26 via pivot shafts 29, 30 resp. 31, 32 are respectively connected pivotable to sealing beams 33, 34 respective a movement connection link 35. Movement actuation of the link 35 entails rotation of the seal 19 about the joints 27, 28 from a first lowered position A to a sealing position T.

In order to provide an efficient and safe waterproof sealing function along the whole periphery of the door, the door sheet 9 exhibits vertical seals 22, 21 at vertical door lateral edges 9A, 9B, respectively extending along said vertical door lateral edges 9A, 9B faced to act in a common direction 38 towards one lateral edge 9A of the door sheet. Further the door sheet 9 exhibits upper and lower located seals 19 and 20 respectively, laterally displaced in relation to one 21 of said seals 19–22. Between said horizontal seals 19, 20 respectively and one of the vertical seals 21 there is provided sealing coupling parts 39, 40 extending across the door sheet closing plane 10. Said sealing coupling parts 39,40 are arranged to be able to join the seals to a common continous loop 41 of seal, which extends about the opening of the door at closed position of the door 5.

In the corner area 42–45 of the sealing sling 41 there is provided an inclined part 46–49 of the loop with in pairs arranged upper 46, 49 and lower 47, 48 sealing portions respectively, which run in a common direction of inclination 50 and 51 respectively.

Inclined portion ends 52, 53 and 54, 55 respectively encountering each other are provided at the sealing sling 41 at the area of movable seal 19.

As is shown in FIGS. 8 and 9, a door sheet 9 can be supported displaceably guided by a race wheel 56 movable between said positions O and S respectively, driven for example by means of a wheel 57A, 57B enmeshed chain etc. 57, which is fixed by means of a fastening device 57C and which is actuated by for example a hydraulic motor 58. The race wheels 56 can be arranged to be guided by tracks 59, which run along the intended closing plane 10 of the door, whereby indentations of the track 59 may be situated such that respective wheel 56 is lowered down therein when the door 9 displaced to its intended sealing position, so that the door is retained efficiently in the intended position.

A fire seal 75 may be provided by at least the upper movable seal 19 in the purpose of making the door 5 fireproof.

Figure 11:
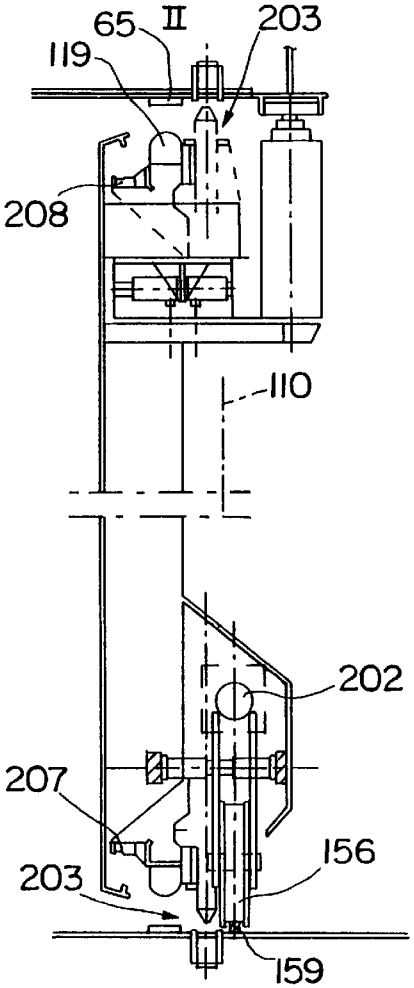
FIG. 11 shows a further vertical sectional view of the door in opened position.
Figure 10:
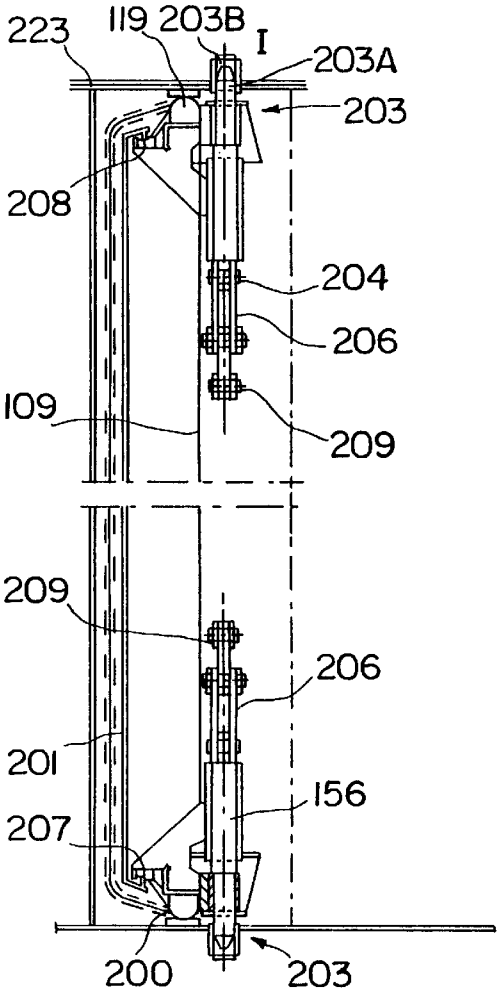
FIG. 10 shows a vertical sectional view of the door shown in FIG. 8 in closed position and with a race wheel shown.
Figure 12D:
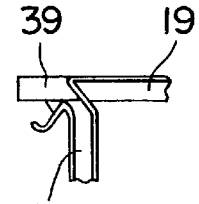
FIG. 12D is an enlarged sectional view of part of FIG. 12A.
Figure 12E:
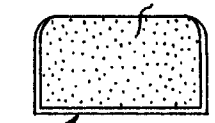
FIG. 12E is an enlarged sectional view of part of FIG. 12A.
Figure 12F:
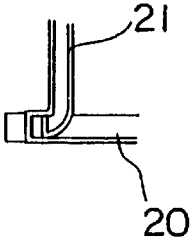
FIG. 12F is an enlarged sectional view of FIG. 12A.
Figure 12B:
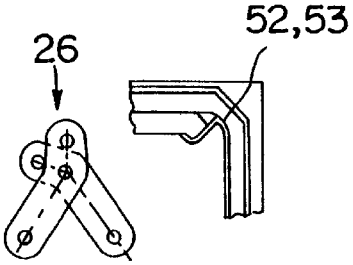
FIG. 12B is an enlarged sectional view of part of FIG. 12A, shown alongside a pivot arm.
Figure 12C:
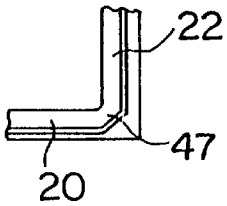
FIG. 12C is an enlarged sectional view of part of FIG. 12A.
Figure 12A:
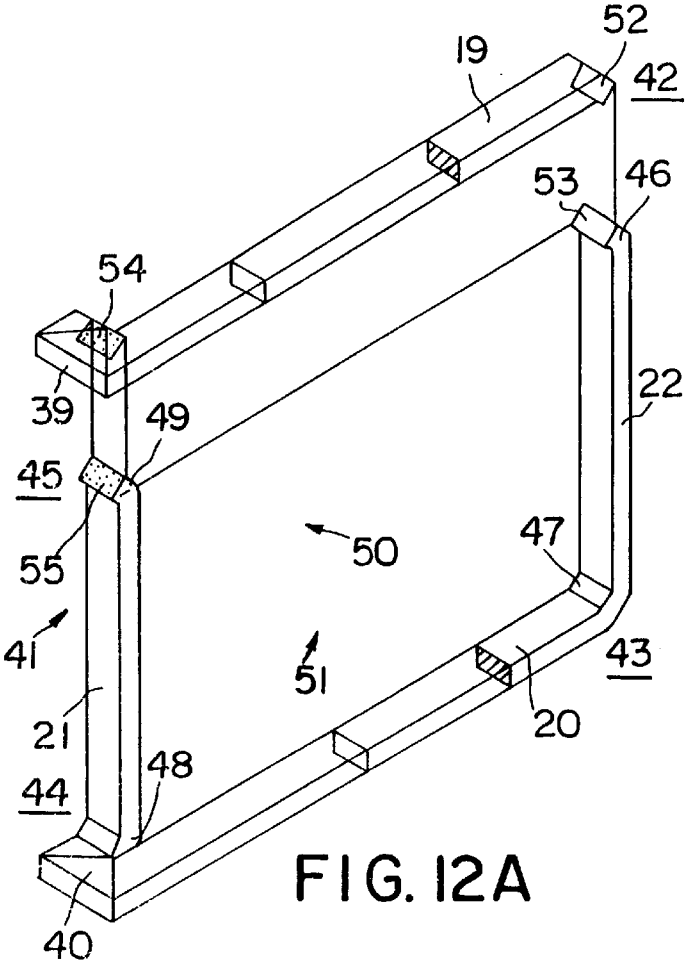
FIG. 12A shows a diagrammatic perspective view of a sealing sling.

A lower door seal 200 can be movable or fixedly connected with the lower edge area of a door sheet, for example movable such as is shown in FIGS. 10–11, and with vertical fixed seals 201 situated at the lateral edge areas of the door sheet. The door sheet 109 is preferably supportable by wheels 156 journalled to be swung about a pivot axis 202, which extends along the closing plane 110 of the door sheet. Said wheels may be guided by a track 159 along the closing plane 210 of said door sheet, which track may exhibit above stated indentations at the area of the closing position of the door sheet.

An upper and a lower located seal 119 may be movably joined with the door blocking means 203, in order to batten down the door by common movement actuation. A preferably common driving device 204, which may be situated in the interior of the door, via links 209 and pivot arms 206 may be provided to influence the blocking means 203 to be passed between locked I and unlocked II position respectively with the blocking means 203 for example constituted by plunges 203A received in fitting reception openings 203B in the decks 223.

Said movable seal 19; 119; 200, but preferably even fixed seals 20, may be supported and joined by means of movement with a beam seal 60; 207, 208 each.

In FIGS. 2 and 3 a movable seal 19 is shown constituted by a beam seal 61 guided along vertical side plates 62, 63 of the door sheet 9 at its upper part, whereby a beam seal 60 is supported by a support connection 64 connected to said sealing beam 61.

Along the circumference of the door 5 and its sealing sling 41 a harder stop sling 65 is provided, for example a metal ledge, against which the seal 41 is pressed for efficient seal. Even harder stop 66 is provided, by means of which the drain seal 60 may cooperate, for example a part of the seal guide plate 63.

A sealing body or bodies may preferably be constituted by resilient compressible material. For example rubber material and/or a body with hollow formed cross sectional form for reception air etc is suitable.

The function of the invention should have been evident from the above stated and what has been shown in the drawings, the invention not being limited thereto, but can be varied within the scope of the patent claims without departing from the inventive concept.

What is claimed is:

1. In combination, a sealing device for forming a seal between a peripheral edge of a bulkhead door sheet and a bulkhead, a bulkhead door sheet having a periphery defined by a pair of horizontal and vertical edges and slidable between an open and closed position, and a bulkhead having an opening edge that is slidable by said sealing device, wherein a seal portion of said sealing device extends at least along one horizontal edge of the door sheet and is connected with the door sheet, said door sheet movable from an unsealed position to a sealed position, said unsealed and sealed positions respectively corresponding to said open and closed position of said door sheet, and wherein a door blocking means is movably joined with the seal portions for a common movement actuation, the door blocking means disposable in a plurality of reception openings in said door sheet when the seal portion is in the sealed position, and wheels for supporting the door sheet, the wheels coupled to the door sheet at a pivot axis and guided by tracks extending along a closing plane of the door sheet, which tracks exhibit indentations at an area of the closing position of the door sheet.

2. The device according to claim 1 wherein the seal portion and a beam seal are supported by a movable support connection.

3. The device according to claim 1, wherein the seal portions are formed of resilient compressible material.

4. In combination, a sealing device for use between a bulkhead of the type having an opening edge and a bulkhead door of the type having a peripheral edge defined by a pair of horizontal and vertical edges, wherein:

at least two angled pivot arms are adapted to be pivotally coupled to the door, each pivot arm having an opposed pair of ends and an actuatable connection link coupled between one end on each of said pivot arms and a pair of horizontal sealing porions are adated for attachment along opposing horizontal edge portions of the bulkhead door to be sealed and a pair of vertical sealing portions for attachment along opposing vertical edge portions of the bulkhead door to be sealed and seal coupling parts coupled to the horizontal sealing portions and joinable with the vertical sealing portions to form a continuous common sealing seal that is adapted to extend around the door, the vertical sealing portions each comprising an upper corner area having an inclined end portion, wherein one of the horizontal sealing portions includes opposing inclined end portions, each of said inclined end portions of the vertical sealing portions respectively engaging the inclined end portions on one of the horizontal sealing portions while in a sealed position to form the continuous sealing seal wherein a door blocking means is movably joined with the seal portions for a common movement actuation, the door blocking means adapted to be disposable in a plurality of reception openings in the door to be sealed when the seal portions are in the sealed position; and wheels for supporting the bulkhead door to be sealed are adapted to be coupled to the door at a pivot axis.

5. In combination, a sealing device for use between a bulkhead of the type having an opening edge and a bulkhead door of the type having a peripheral edge defined by a pair of horizontal and vertical edges, wherein:

at least two angled pivot arms are adapted to be pivotally coupled to the door; each pivot arm having an opposed pair of ends and an actuatable connection link coupled between one end on each of said pivot arms and a pair of horizontal sealing portions are adapted for attachment along opposing horizontal edge portions of the bulkhead door to be sealed and a pair of vertical sealing portions are adapted for attachment along opposing vertical edge portions of the bulkhead door to be sealed and seal coupling parts coupled to the horizontal sealing portions and joinable with the vertical sealing portions to form a continuous common sealing seal that is adapted to extend around the door, the vertical sealing portions each comprising an upper corner area having an inclined end portion, and wherein one of the horizontal sealing portions includes opposing inclined end portions each of said inclined end portions of the vertical sealing portions respectively engaging the inclined end portions on one of the horizontal sealing portions while in a sealed position to form the continuous sealing seal wherein a door blocking means is movably joined with the seal portions for a common movement actuation, the door blocking means adapted to be disposable in a plurality of reception openings in the door to be sealed when are in the sealed position; and wheels for supporting the bulkhead door to be sealed are adapted to be guided by tracks extending alone a closing plane of the door, said tracks exhibit indentations at an area of the closing position of the door.

* * * * *